US007791563B2

(12) United States Patent
Han et al.

(10) Patent No.: US 7,791,563 B2
(45) Date of Patent: Sep. 7, 2010

(54) PLASMA DISPLAY AND METHOD FOR FLOATING ADDRESS ELECTRODES IN AN ADDRESS PERIOD

(75) Inventors: Jung Gwan Han, Gumi-si (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 982 days.

(21) Appl. No.: 11/168,457

(22) Filed: Jun. 29, 2005

(65) Prior Publication Data

US 2006/0001602 A1 Jan. 5, 2006

(30) Foreign Application Priority Data

Jun. 30, 2004 (KR) ..... 10-2004-0050838

(51) Int. Cl.
*G09G 3/28* (2006.01)

(52) U.S. Cl. ..... 345/67; 315/169.4

(58) Field of Classification Search ..... 345/204, 345/60, 67, 63; 315/169.4
See application file for complete search history.

(56) References Cited

U.S. PATENT DOCUMENTS

| | | | | |
|---|---|---|---|---|
| 6,376,995 | B1 * | 4/2002 | Kato et al. | 345/67 |
| 2002/0180668 | A1 * | 12/2002 | Ide et al. | 345/60 |
| 2002/0180669 | A1 | 12/2002 | Kim et al. | |
| 2003/0058194 | A1 * | 3/2003 | Kang | 345/63 |
| 2003/0174101 | A1 * | 9/2003 | Kawasaki et al. | 345/60 |
| 2005/0259057 | A1 * | 11/2005 | Lee et al. | 345/87 |
| 2006/0262041 | A1 * | 11/2006 | An | 345/67 |

FOREIGN PATENT DOCUMENTS

| | | |
|---|---|---|
| EP | 1388841 A2 | 2/2004 |
| JP | 4-130396 A | 5/1992 |
| JP | 5-188878 | 7/1993 |
| JP | 8-123362 | 5/1996 |

OTHER PUBLICATIONS

Jeong Hyun Seo, et al., "Two-Dimensional Modeling of a Surface Type Alternating Current Plasma Display Panel Cell: Discharge Dynamics and Address Voltage Effects," IEEE Transactions on Plasma Science, vol. 29, No. 5, Oct. 1, 2001, pp. 824-831.

A. Okigawa, et al., "Diagnosis of AC-PDP Micro-Cell Discharges by Space- and Time-resolved Laser Absorption Spectroscopy," 1999 SID International Symposium, May 18, 1999, 4 pages.

* cited by examiner

*Primary Examiner*—Chanh Nguyen
*Assistant Examiner*—Allison Walthall
(74) *Attorney, Agent, or Firm*—McKenna Long & Aldridge LLP

(57) ABSTRACT

The present invention relates to a plasma display apparatus and a method of driving the same. The plasma display apparatus according to the present invention includes a plasma display panel in which data electrodes are formed; and a data voltage controller for applying a data voltage as a floating state or a first state voltage to the data electrodes. The method of driving a plasma display apparatus according to the present invention includes the steps of: (a) applying a first voltage to the data electrodes; and (b) applying a voltage as a ground level or a floating state to the data electrodes.

8 Claims, 10 Drawing Sheets

PLASMA DISPLAY AND METHOD FOR FLOATING ADDRESS ELECTRODES IN AN ADDRESS PERIOD

This Nonprovisional application claims priority under 35 U.S.C. §119(a) on Patent Application No. 10-2004-0050838 filed in Korea on Jun. 30, 2004, the entire contents of which are hereby incorporated by reference.

BACKGROUND OF THE INVENTION

1. Field of the Invention

The present invention relates to a plasma display apparatus and a method of driving the same.

2. Description of the Background Art

In general, a plasma display panel excites phosphor due to 147 nm ultraviolet rays generated when an inert gas such as a combination of helium and xenon (He+Xe) or neon and xenon (Ne+Xe) is discharged, thereby displaying an image including characters and graphics.

FIG. 1 is a perspective view illustrating a structure of a general plasma display panel. As shown in FIG. 1, the plasma display panel comprises a scan electrode 12A and a sustain electrode 12B formed on an upper substrate 10, and a data electrode 20 formed on a lower substrate 18.

The scan electrode 12A and the sustain electrode 12B include a transparent electrode and a bus electrode, respectively. The transparent electrode is made of Indium-Tin-Oxide (ITO). The bus electrode is made of metal for reducing resistance.

An upper dielectric layer 14 and a protection layer 16 are sequentially laminated on the top of the upper substrate 10 on which the scan electrode 12A and the sustain electrode 12B are formed.

Wall charge is charged on the upper dielectric layer 14, the wall charge being generated when plasma is discharged. The protection layer 16 prevents the upper dielectric layer 14 from damaging due to sputtering generated when plasma is discharged and enhances efficiency of second electron emission at the same time. The protection layer 16 is usually made of magnesium oxide (MgO).

Meanwhile, the lower dielectric layer 22 and a barrier rib 24 are sequentially formed on the top of the lower substrate 18 on which the data electrode is formed. A phosphor layer 26 is coated on the surface of the lower dielectric layer 22 and the barrier rib 24.

The data electrode 20 is formed in the direction to cross the scan electrode 12A and the sustain electrode 12B. The barrier rib 24 is formed parallel with the data electrode 20 to prevent ultraviolet rays and visible rays generated by discharge from being leaked to adjacent discharge cells.

The phosphor layer 26 is excited due to ultraviolet rays generated when plasma is discharged to generate any one visible ray of red, green and blue. An inert gas for discharge such as a combination of helium and xenon (He+Xe) or neon and xenon (Ne+Xe) is injected in discharge space of a discharge cell formed between the upper/lower substrate 10 or 18 and the barrier rib 24.

FIG. 2 is a driving waveform illustrating a method of driving a conventional plasma display panel. Referring to FIG. 2, the conventional plasma display panel is driven by being divided into a reset period for initializing the whole picture, an address period for selecting discharge cells and a sustain period for sustaining discharge of selected cells.

First, the reset period is driven by being divided into a setup period (SU) and a setdown period (SD). In the setup period, a rising ramp waveform (Ramp-up) is simultaneously applied to all the scan electrodes (Y), and discharge is generated within the cells of the whole picture due to the rising ramp waveform (Ramp-up). Further, positive wall charge is charged on the address electrodes (X) and the sustain electrodes (Z), and negative wall charge is charged on the scan electrodes (Y) due to the setup discharge. In the setdown period (SD), a rising ramp waveform (Ramp-up) generates weak erasing discharge within the cells, thereby erasing a portion of the overcharged wall charge, the rising ramp waveform (Ramp-up) falling from a positive voltage lower than the peak voltage of the ramp-up waveform to a ground voltage (GND) or a negative specific voltage level after the rising ramp waveform (Ramp-up) is applied. Wall charge uniformly remains within the cells to a degree in that address discharge can stably be generated by the setdown discharge.

In the address period, a negative scan pulse (Scan) is sequentially applied to the scan electrodes (Y) and simultaneously synchronized with the scan pulse so that a positive data pulse (data) is applied to the address electrodes (X). The difference between the scan pulse and the data pulse, and the voltage of the wall charge generated in the reset period are added so that address discharge is generated within the cell to which the data pulse is applied. Wall charge remains within the cells selected due to the address discharge to a degree in that discharge can be generated when a sustain voltage is applied. A positive direct current voltage (Zdc) is applied to the sustain electrode Z so that the sustain electrode (Z) does not cause wrong discharge with the scan electrode (Y) by reducing the voltage difference with the scan electrode (Y) during the setdown and the address periods.

In the sustain period, a sustain pulse (Sus) is alternately applied to the scan electrodes (Y) and the sustain electrodes (Z). The voltage of the wall charge within the cell and the sustain pulse are added to the cell selected due to the address discharge so that sustain discharge, that is, display discharge is generated between the scan electrode (Y) and the sustain electrode (Z) whenever each sustain pulse is applied. Further, after the sustain discharge is completed, a ramp waveform (Ramp-ers) having a small pulse width and a voltage level is applied to the sustain electrode (Z) so that wall charge remaining within the cells of the whole picture is erased.

FIG. 3 is a circuit diagram illustrating operation of a driving circuit driven during an address period in a conventional plasma display panel.

Referring to FIG. 3, if a channel corresponding to a first scan electrode (Y1) is selected in a scanning process during the address period, channels corresponding to the rest of the scan electrodes (Y2, Y3, . . . , Yn) are not selected.

If a channel is selected in such a manner, a second switching element 213-1 of a first scan driver 210-1 corresponding to the selected channel and a switching element 220 for scanning are turned on.

At the same time, a first switching elements 211-2 to **211-*n* of scan drivers 210-2 to 210-*n* corresponding to the channels which are not selected and a switching element 230** for grounding are turned on.

If the switching elements operate in such a manner and a data voltage (+Vd or 0V) is applied to data electrodes (X1 to Xm) due to operations of first data switching elements 310-1 to **310-*m* or second data switching elements 320-1 to 320-*m* of a data driver IC 300**. Therefore, write operations are performed within cells located on a first line.

Further, a data pulse is grounded via the first switching elements 211-2 to **211-*n* of the scan drivers 210-2 to 210-*n* corresponding to the rest of the scan electrodes (Y2 to Yn) and the switching element 230** for grounding.

If such a process is performed on all the scan electrodes, a scanning process is finished.

Meanwhile, a first switching element 240 for sustaining, second switching elements 213-2 to **213-*n* of the scan drivers 210-1 to 210-*n* and a switching element 260** for grounding are turned on after the scanning process.

Accordingly, a first sustain voltage (+Vsy), the first switching element 240 for sustaining, the second switching elements 213-2 to **213-*n* of the scan drivers 210-1 to 210-*n*, each of the scan electrodes (Y1 to Yn), the sustain electrodes (Z1 to Zn) and the switching element 260 for grounding make a loop so that the sustain voltage (+Vsy) is applied to the scan electrodes (Y1** to Yn).

Next, a second switching element 250, the first switching elements 211-2 to **211-*n* of the scan drivers 210-1 to 210-*n* and the switching element 230** for grounding are turned on.

Accordingly, a second sustain voltage (+Vsz), the sustain electrodes (Z1 to Zn), the scan electrodes (Y1 to Yn), the first switching elements 211-2 to **211-*n* of the scan drivers 210-1 to 210-*n* and the switching element 230 for grounding make a loop so that the sustain voltage (+Vsz) is applied to the sustain electrodes (Z1** to Zn).

Such a driving apparatus of the plasma display panel applies a scan voltage (−Vyscan) and a data voltage (+Vd or 0V) to corresponding electrodes through switching operations of switching elements included in the scan drivers 210-1 to **210-*n* and data driver ICs 300-1 to 300-*m* in the scan period, and a displacement current (Id) flows in the data driver ICs 300-1 to 300-*m*** through the data electrodes in this process.

Since a general plasma display panel has a three-electrode structure, a first equivalent capacitor (Cm1) exists between two data electrodes adjacent to each other, and a scond equivalent capacitor (Cm2) exists between a data electrode and a scan electrode, or a data electrode and a sustain electrode as shown in FIG. 3

Thus, since the state of a voltage applied to the electrodes varies depending on the operations of the switching elements included in the scan drivers 210-1 to **210-*n* and the data driver ICs 300-1 to 300-*m* in a scanning process, the displacement current (Id) generated due to the first equivalent capacitor (Cm1) and the second equivalent capacitor (Cm2) flows in the data driver ICs 300-1 to 300-*m***) through the data electrodes.

However, a displacement current flowing in such data driver ICs 300-1 to **300-*m* and a magnitude of electric power according thereto vary depending on image data applied to the data electrodes (X1** to Xm).

The magnitude of a displacement current flowing in such data driver ICs 300-1 to **300-*m*** can be expressed in equation 1 as follows:

$$id = C \times (dv/dt) \times f \qquad \text{EQUATION 1}$$

"id" means the magnitude of a displacement current flowing through a data electrode, "C" means a capacitance between two data electrodes adjacent to each other, a data electrode and a scan electrode, or a data electrode and a sustain electrode, "dv/dt" means the variation of a voltage per time in a data electrode, and "f" means the number of voltage variance times of a data electrode.

FIG. 4 is a waveform of an image signal in which a displacement current generated in a conventional plasma display panel becomes maximized.

As shown in FIG. 4, a placement current calculated with the equation becomes the largest when the phase difference between image data applied to data electrodes in case that a scan electrode is scanned and image data applied to the data electrodes in case that the next scan electrode is scanned is 1/2 period.

In other words, in case that such image data are applied, an electric potential of a data electrode varies from a data voltage (Vd) to a ground level or from a ground level to a data voltage (Vd) whenever each scan electrode is scanned as shown in FIG. 2. In this case, since the capacitance "C" and "f" of the equation becomes maximized, the magnitude of a displacement current (id) becomes maximized. In case that such a maximized displacement current (id) flows in the data driver ICs 300-1 to **300-*m* shown in FIG. 3, there is a drawback in that the data driver ICs 300-1 to 300-*m*** becomes damaged.

Meanwhile, in case that a driver IC which has an excellent withstand voltage property is used to prevent a maximized displacement current from flowing in the data driver IC 300-1 to **300-*m***, there is a drawback in that a manufacturing cost is considerably increased.

FIG. 5 is a view illustrating a picture displayed due to image data in which a displacement current generated in a conventional plasma display panel becomes maximized.

As shown in FIG. 5, the image data picture, in which a displacement current becomes maximized, has a lattice pattern. Thus, a maximized displacement current (id) is generated if an image data with the lattice pattern is input. As shown in FIG. 6, such a lattice pattern is used for a dither mask of 4/8 level used in a dithering process for enhancing a picture quality in a conventional plasma display panel. Therefore, since a maximized displacement current is generated in all the plasma display panels for enhancing picture quality by using a dithering process, there is more frequently generated damage of data driver ICs.

SUMMARY OF THE INVENTION

Accordingly, an object of the present invention is to solve at least the problems and disadvantages of the background art.

An object of the present invention is to provide a plasma display apparatus and a method of driving the same, wherein the magnitude of a displacement current generated when data are applied in a plasma display panel is minimized, thereby preventing damage of a data driver IC.

To achieve these and other advantages and in accordance with the purpose of the present invention, as embodied and broadly described, there is provided a plasma display apparatus including: a plasma display panel in which data electrodes are formed; and a data voltage controller for applying a data voltage as a floating state or a first state voltage to the data electrodes.

In another aspect of the present invention, there is provide A plasma display apparatus including: a plasma display panel in which data electrodes are formed; and a data voltage controller for applying a voltage which is lower than a data reference voltage and higher than a ground level to the data electrodes.

In further another aspect of the present invention, there is provided A method of driving a plasma display apparatus which is driven by applying a data voltage to data electrodes, the method including the steps of: (a) applying a first voltage to the data electrodes; and (b) applying a voltage as a ground level or a floating state to the data electrodes.

In still another aspect of the present invention, there is provided a method of driving a plasma display apparatus which is driven by applying a data voltage to data electrodes, the method including the steps of: (a) applying a first voltage to the data electrodes; and (b) applying a second voltage which is lower than the first voltage and higher than a ground level to the data electrodes.

According to The present invention, the magnitude of a displacement current generated when data are applied in a plasma display panel is minimized, thereby protecting a data driver IC.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
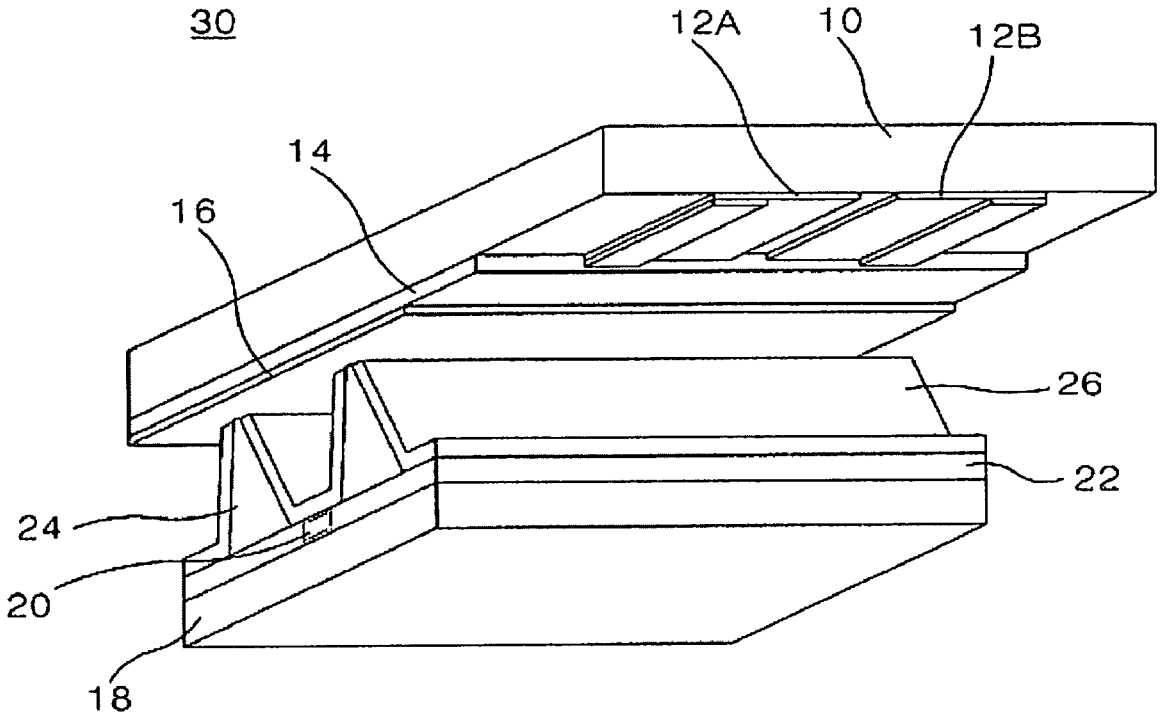
Fig. 1 PRIOR ART
FIG. 1 is a perspective view illustrating a structure of a general plasma display panel.
Figure 2:
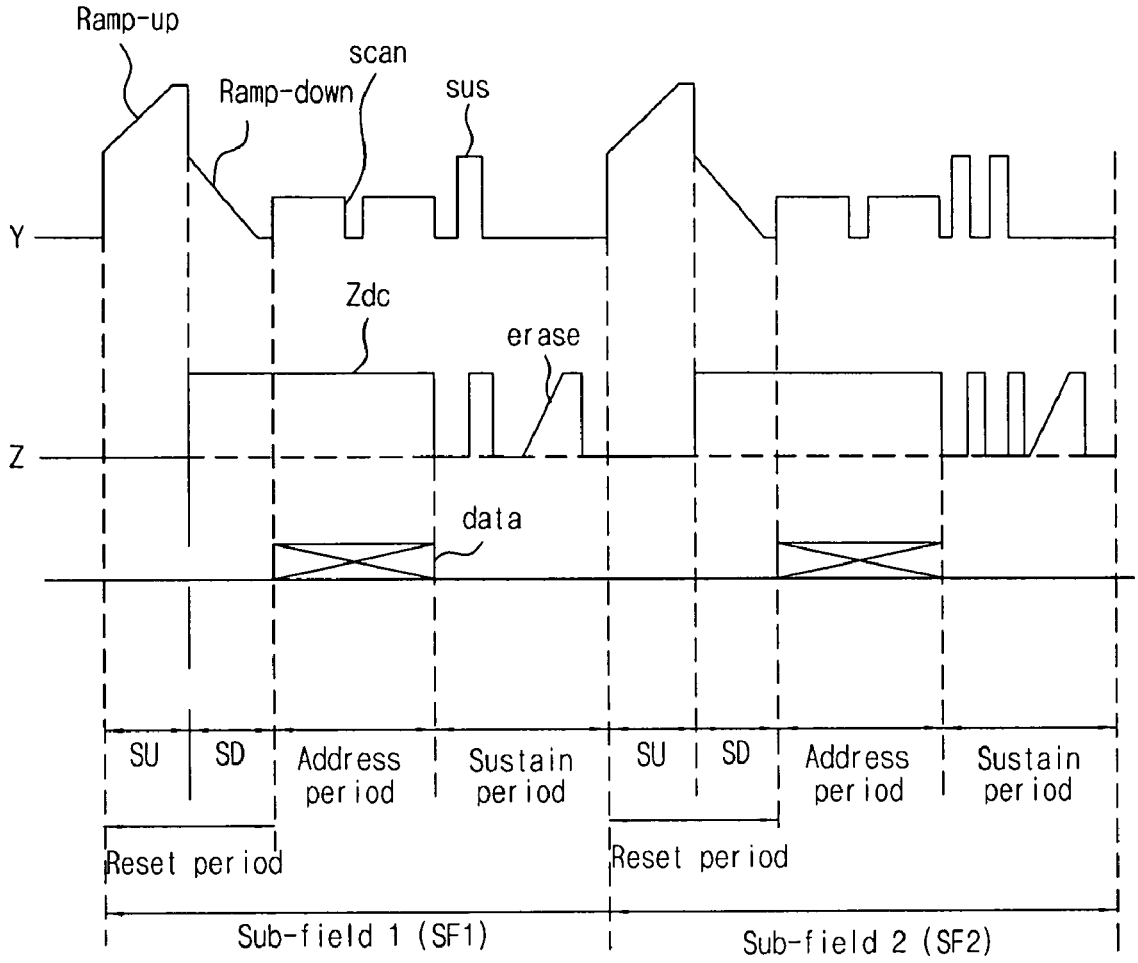
Fig. 2 PRIOR ART
FIG. 2 is a driving waveform illustrating a method of driving a conventional plasma display panel.
Figure 3:
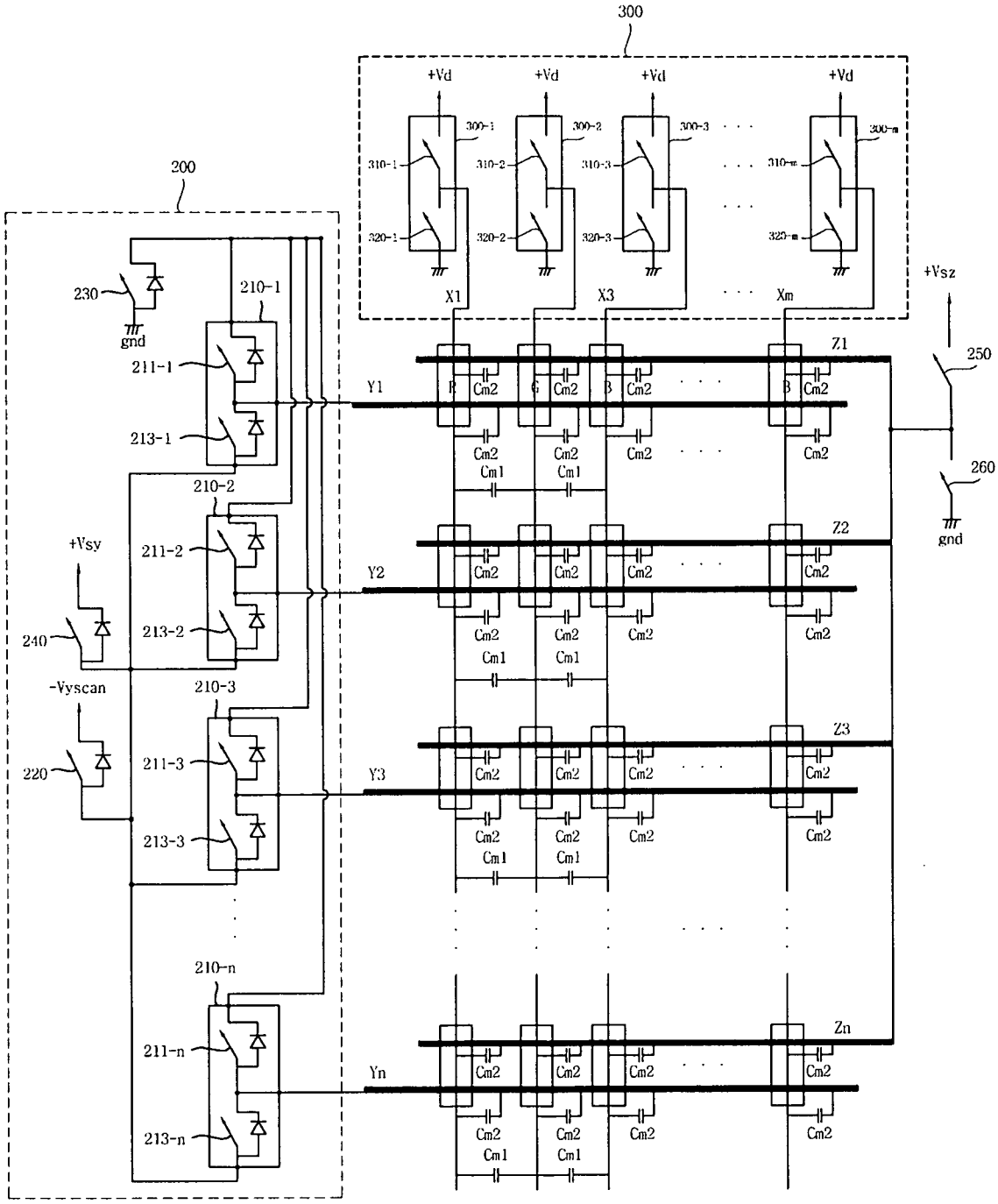
Fig. 3 PRIOR ART
FIG. 3 is a circuit diagram illustrating operation of a driving circuit driven during an address period in a conventional plasma display panel.
Figure 4:
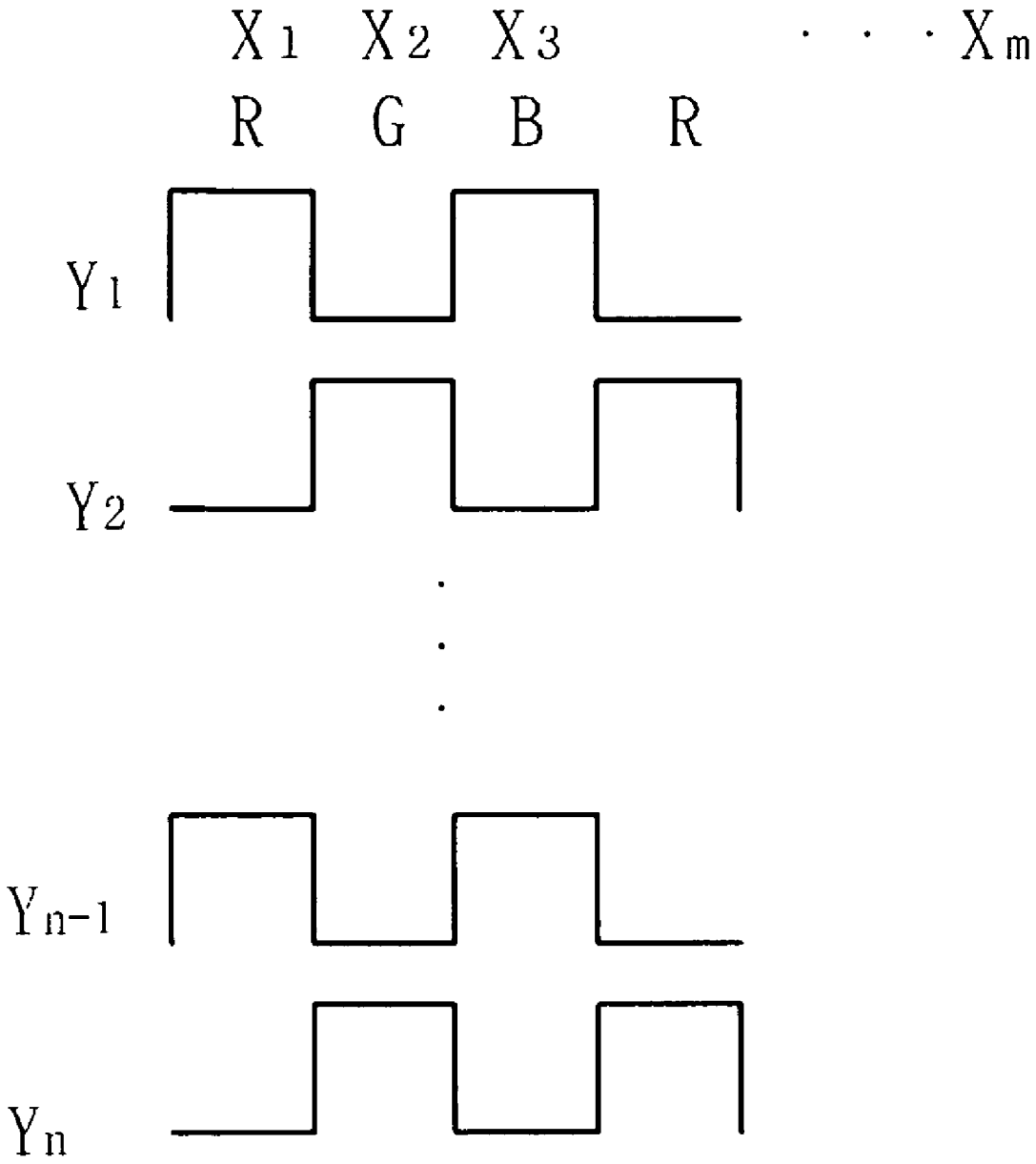
Fig. 4 PRIOR ART
FIG. 4 is a waveform of an image signal in which a displacement current generated in a conventional plasma display panel becomes maximized.

Preferred embodiments of the present invention will be described in a more detailed manner with reference to the drawings.

A plasma display apparatus according to the present invention includes a plasma display panel in which data electrodes are formed; and a data voltage controller for applying a data voltage as a floating state or a first state voltage to the data electrodes.

Preferably, the first state voltage is a ground level.

Preferably, the data voltage controller applies the data voltage as the floating state, the first state or a second state voltage.

Preferably, the floating state or the first state of the data voltage is adjusted depending on the magnitude of a displacement current by the data voltage.

Preferably, the data voltage controller includes a first data switching element for controlling application of a data reference voltage; and a second data switching element for controlling application of the ground level, wherein the first and the second data switching elements are turned off to form the floating state.

Preferably, the floating state is generated at an interval in that a ground level is applied to data electrodes in case that an electric potential applied to the data electrodes varies from a data reference voltage to a ground level.

Preferably, the floating state is generated at a portion of the interval in that the ground level is applied to data electrodes in case that an electric potential applied to the data electrodes varies from a data reference voltage to a ground level.

Preferably, the floating state is generated from the data reference voltage in case that an electric potential applied to the data electrodes varies from a data reference voltage to a ground level.

A plasma display apparatus according to the present invention includes a plasma display panel in which data electrodes are formed; and a data voltage controller for applying a voltage which is lower than a data reference voltage and higher than a ground level to the data electrodes.

Preferably, the voltage that is lower than a data reference voltage and higher than a ground level is adjusted depending on the magnitude of a displacement current by a data voltage.

Preferably, the data voltage controller comprises a first data switching element for controlling application of the data reference voltage; and a second data switching element for controlling application of a voltage which is lower than the data reference voltage and higher than the ground level.

A method of driving a plasma display apparatus according to the present invention includes the steps of: (a) applying a first voltage to the data electrodes; and (b) applying a voltage as a ground level or a floating state to the data electrodes.

Preferably, the ground level or the floating state is adjusted depending on the magnitude of a displacement current by a data voltage.

Preferably, the floating state is generated at an interval in that a ground level is applied to data electrodes in case that an electric potential applied to the data electrodes varies from a first voltage to a ground level.

Preferably, the floating state is generated at a portion of the interval in that the ground level is applied to data electrodes in case that an electric potential applied to the data electrodes varies from a first voltage to a ground level.

Preferably, the floating state is generated from the first voltage level in case that an electric potential applied to the data electrodes varies from a first voltage to a ground level.

A method of driving a plasma display apparatus according to the present invention includes the steps of: (a) applying a first voltage to the data electrodes; and (b) applying a second voltage which is lower than the first voltage and higher than a ground level to the data electrodes.

Preferably, the second voltage is adjusted depending on the magnitude of a displacement current by a data voltage.

Hereinafter, a preferred embodiment of the present invention will be described in a more detailed manner with reference to the drawings.

Figure 7:
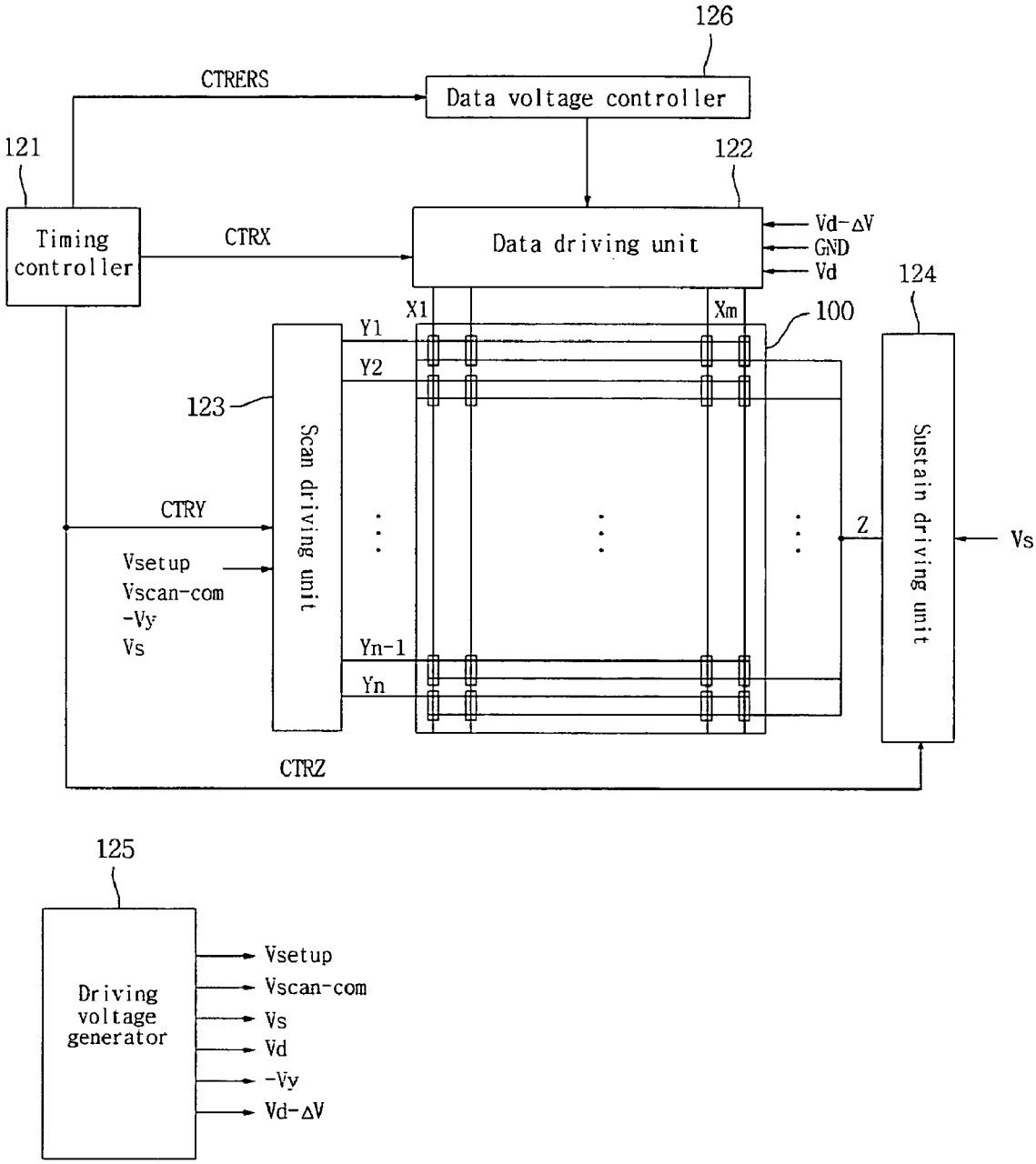
FIG. 7 is a schematic view illustrating a configuration of a plasma display apparatus according to the present invention.

FIG. 7 is a schematic view illustrating a configuration of a plasma display apparatus according to the present invention.

Referring to FIG. 7, the plasma display apparatus according to the present invention includes a plasma display panel 100; a data driving unit 122 for supplying data to data electrodes (X1 to Xm) formed on a lower substrate (not shown) of the plasma display panel 100; a scan driving unit 123 for driving scan electrodes (Y1 to Yn); a sustain driving unit 124 for sustain electrodes (Z) being common electrodes; a data voltage controller 126 for controlling the data driving unit 122 to adjust a data voltage applied to the data electrodes; a timing controller 121 for controlling the data driving unit 122, the scan driving unit 123 and sustain driving unit 124 when the plasma display panel 100 is driven; and a driving voltage generator 125 for supplying a driving voltage required in each of the driving units 122, 123 and 124.

First, in the plasma display panel 100, an upper substrate (not shown) and a lower substrate (not shown) are bonded having a predetermined space therebetween. A plurality of electrodes, for example, the scan electrodes (Y1 to Yn) and the sustain electrodes (Z) are formed on the upper substrate making pairs of each of the scan electrodes and the sustain electrodes, and the data electrodes (X1 to Xm) are formed on the lower substrate to cross the scan electrodes (Y1 to Yn) and the sustain electrodes (Z).

Data are supplied to the data driving unit 122, the data being inverse gamma corrected and error diffused by a inverse gamma correction circuit (not shown) and an error diffusion circuit (not shown), and then being mapped to each sub-field by a sub-field mapping circuit (not shown). Such a data driving unit 122 samples, latches data in response to a timing control signal (CTRX) output from the timing controller 121 and then supplies the data to the data electrodes (X1 to Xm).

The data voltage controller 126 adjusts a data voltage supplied to the data electrodes (X1 to Xm) during an address period by controlling the data driving unit 122. Such a data voltage controller 126 is controlled by the timing controller 121. Here, the data voltage refers to all the state voltages applied during the address period. In other words, the data voltage refers to a data reference voltage (Vd), a voltage (Vd-.DELTA.V) that is lower than the data reference higher than a ground (GND) level, a floating or ground level maintained during a predetermined period. At this time, the data voltage controller 126 maintains the data voltage as a floating state or a ground level depending on a displacement current generated due to data supplied to the data electrodes, and controls a voltage (Vd-.DELTA.V) level that is lower than the data reference voltage (Vd) and higher than the ground (GND) level.

The scan driving unit 123 supplies a predetermined ramp waveform (Ramp) to the scan electrodes (Y1 and Yn) under the control of the timing controller 121 during a reset period and sequentially supplies a scan pulse to the scan electrodes (Y1 and Yn) during an address period so that the the scan driving unit 123 scans the whole plasma display panel. Thereafter, the scan driving unit 123 supplies a sustain pulse to the scan electrodes (Y1 and Yn) to generate display discharge during a sustain period.

The sustain driving unit 124 supplies a sustain pulse to the sustain electrodes (Z) to generate display discharge by alternately operating with the scan driving unit 123 under the control of the timing controller 121.

The timing controller 121 controls each of the driving units and the controller 122, 123, 124 and 126 by having a vertical/horizontal synchronous signal and a clock signal input, generating timing control signals (CTRX, CTRY, CTRZ, CTRERS1) for controlling each of the driving units 122, 123 and 124, operation timing and sychronization of the data voltage controller 126 in a reset, an address and a sustain periods, and supplying the timing control signals (CTRX, CTRY, CTRZ, CTRERS1) to the corresponding driving units 122, 123 and 124 and the data voltage controller 126.

Meanwhile, a sampling clock for sampling data, a latch control signal and a switch control signal for controlling on/off time of an energy recovery circuit and a driving switch element are included in the data control signal (CTRX). In the scan control signal (CTRY), a switch control signal for controlling on/off time of an energy recovery circuit and a driving switch element within the sustain driving unit 124 is included. Further, a switch control signal for controlling on/off time of an energy recovery circuit and a driving switch element within the sustain driving unit 124 is included in the sustain control signal (CTRZ).

The driving voltage generator 125 generates a setup voltage (Vsetup), a scan common voltage (Vscan-com), a scan voltage (−Vy), a sustain voltage (Vs), data voltages (Vd, Vd-ΔV, GND) and so on. Such driving voltages may vary depending on a composition of discharge gas or a structure of a discharge cell.

Figure 5:
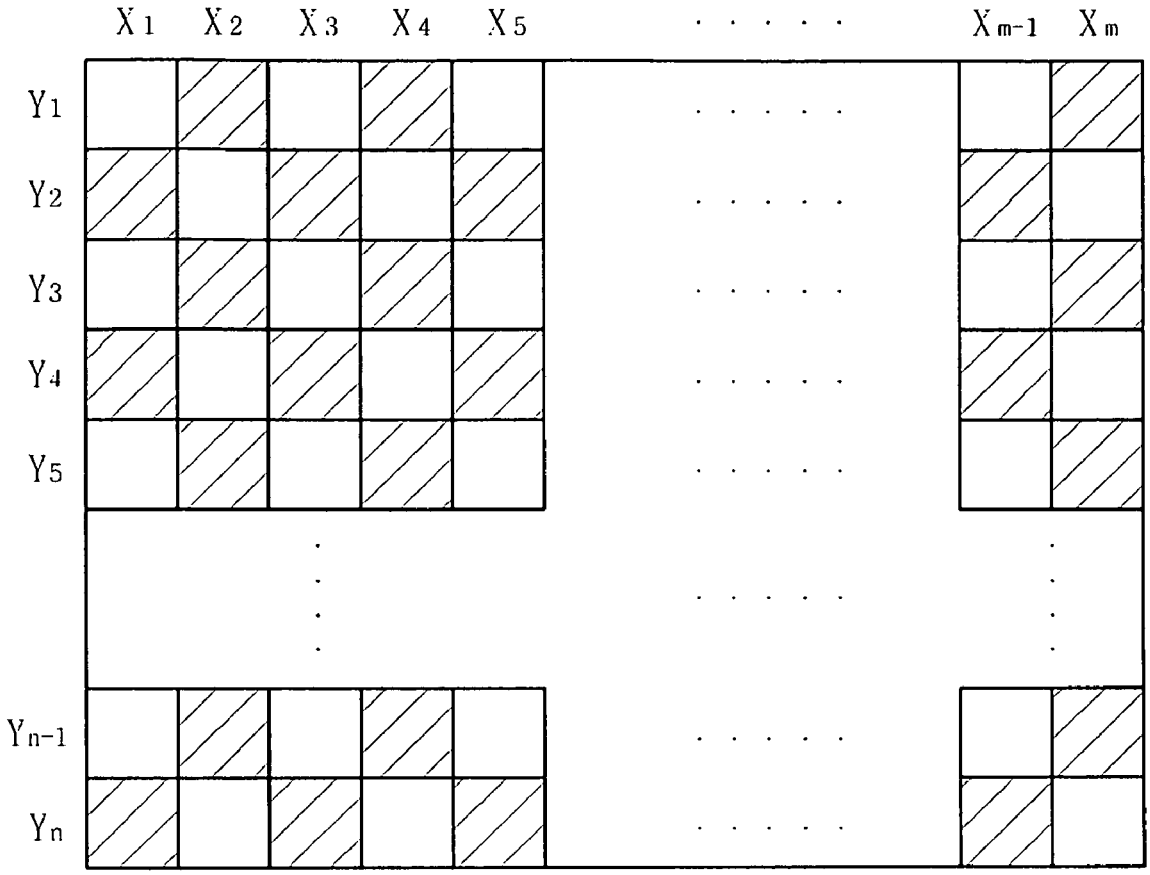
Fig. 5 PRIOR ART
FIG. 5 is a view illustrating a picture displayed due to image data in which a displacement current generated in a conventional plasma display panel becomes maximized.
Figure 6:
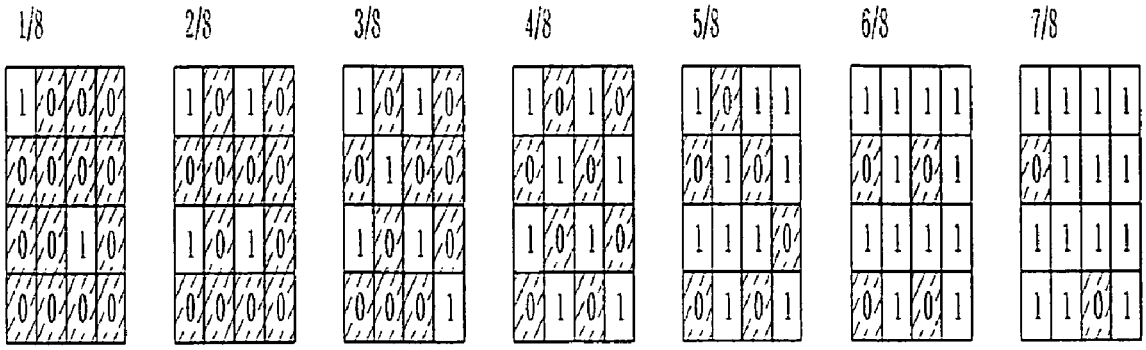
Fig. 6 PRIOR ART
FIG. 6 is a view illustrating a dither mask pattern of 4/8 level used in a dithering process for enhancing a picture quality in a conventional plasma display panel.
Figure 8:
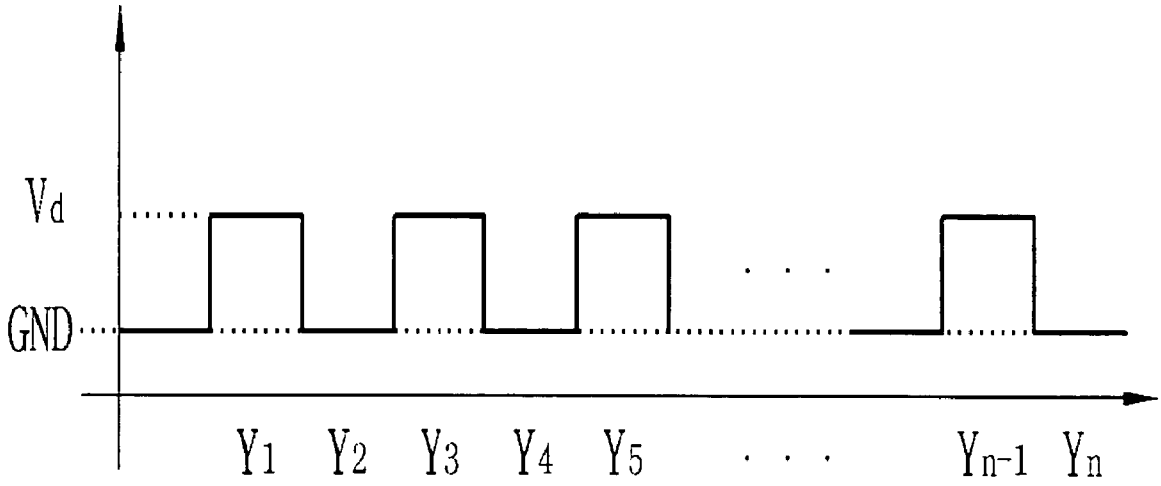
FIG. 8 is a graph showing variance in electric potential of a data electrode depending on a conventional lattice pattern to illustrate a method of driving a plasma display apparatus according to the present invention.

FIG. 8 is a graph showing variance in electric potential of a data electrode depending on a conventional lattice pattern to illustrate a method of driving a plasma display apparatus according to the present invention. In other words, if image data corresponding to the lattice pattern shown in FIG. 5 is applied to data electrodes, the electric potential variance of a data electrode varies from a data voltage (Vd) to a ground level (0V) whenever a scan electrode is scanned.

Such electric potential variance is accomplished by operations of the first data switching elements 310-1 to **310-*m* and the second data switching elements 320-1 to 320-*m* of the data driver ICs (300-1 to 300-*m***).

In other words, a first data switching element and a second data switching element of a data driver IC controlling a data electrode are each turned on when a scan electrode is scanned so that a data reference voltage (Vd) is applied to the data electrode. Further, a first data switching element and a second data switching element of a data driver IC controlling a data electrode are turned on and turned off, respectively when the next scan electrode is scanned so that a ground level is applied.

Thus, to reduce the number of switching times of a data driver IC is the key to minimize the magnitude of a displacement current.

FIGS. **9*a* to 9*d*** are circuit diagrams illustrating an operation mode of a data driver IC included in a plasma display apparatus according to the present invention.

Operation modes of a conventional data driver IC are only two. In other words, the two operation modes are that a data reference voltage (Vd) is applied to a data electrode and that a ground level is applied to a data electrode. If there exist two operation modes in such a manner, there is no choice but that the number of switching times increases.

Therefore, the data driver IC included in the plasma display apparatus according to the present invention has four kinds of operation modes. In other words, the four kinds of operation modes are that a data reference voltage (Vd) is applied to a data electrode as shown in FIG. **9*a*, that a ground (GND) level is applied to a data electrode as shown in FIG. 9*b*, that a data electrode becomes a floating state as shown in FIG. 9*c*** and that a voltage (Vd-ΔV) which is lower than a data reference voltage (Vd) and higher than a ground level is applied to a data electrode. Meanwhile, addressing discharge is not generated in a floating state, a ground state and a state of a voltage (Vd-ΔV) which is lower than a data reference voltage (Vd) and higher than a ground level.

FIGS. **10*a* to 10*e*** are graphs illustrating various kinds of variance in a data electrode depending on an operation mode of a data driver IC included in a plasma display apparatus according to the present invention.

Figure 9:
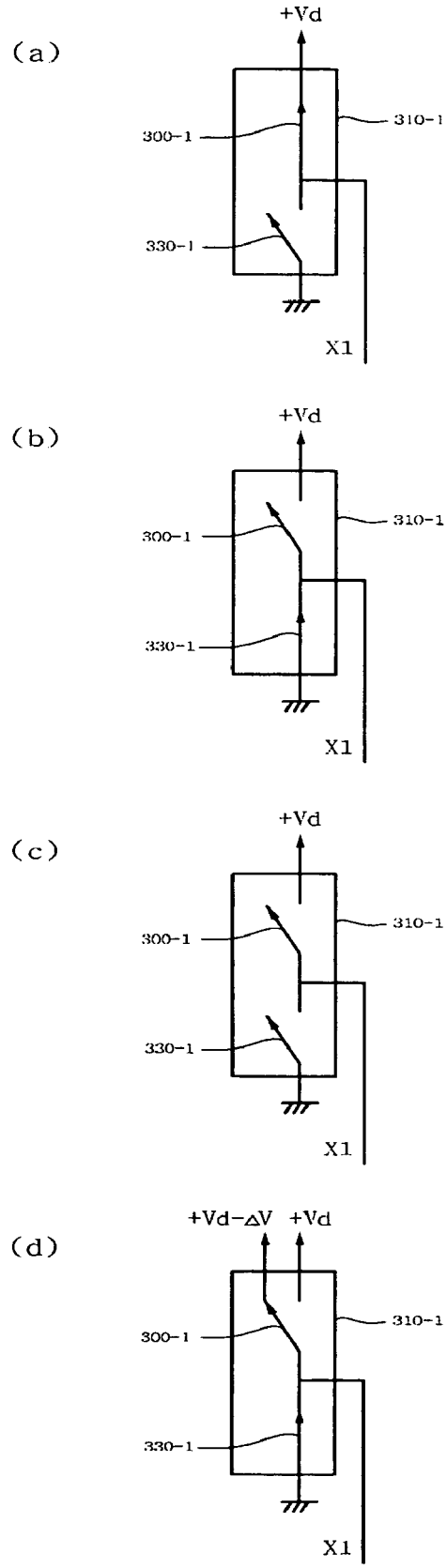
FIGS. 9*a* to 9*d* are circuit diagrams illustrating an operation mode of a data driver IC included in a plasma display apparatus according to the present invention.

First, referring to FIG. **10*a*, electric potential of a data electrode not varies from a data reference voltage (Vd) to a ground (GND) level but is maintained as a floating state when data are supplied to data electrodes as a lattice pattern. The electric potential applied to a data electrode in such a manner varies depending on operations of switching elements included in the present invention. In other words, only the first data switching elements 300-1 to 300-*m* within the data driver IC perform switching operations to apply the data reference voltage (Vd) to a data electrode as shown in FIG. 9*a* and the second data switching elements 330-1 to 330-*m* are turned off and maintained as a floating state as shown in FIG. 9***c* so that the above-mentioned displacement current of the data in accordance with the lattice pattern becomes minimized.

Figure 10:
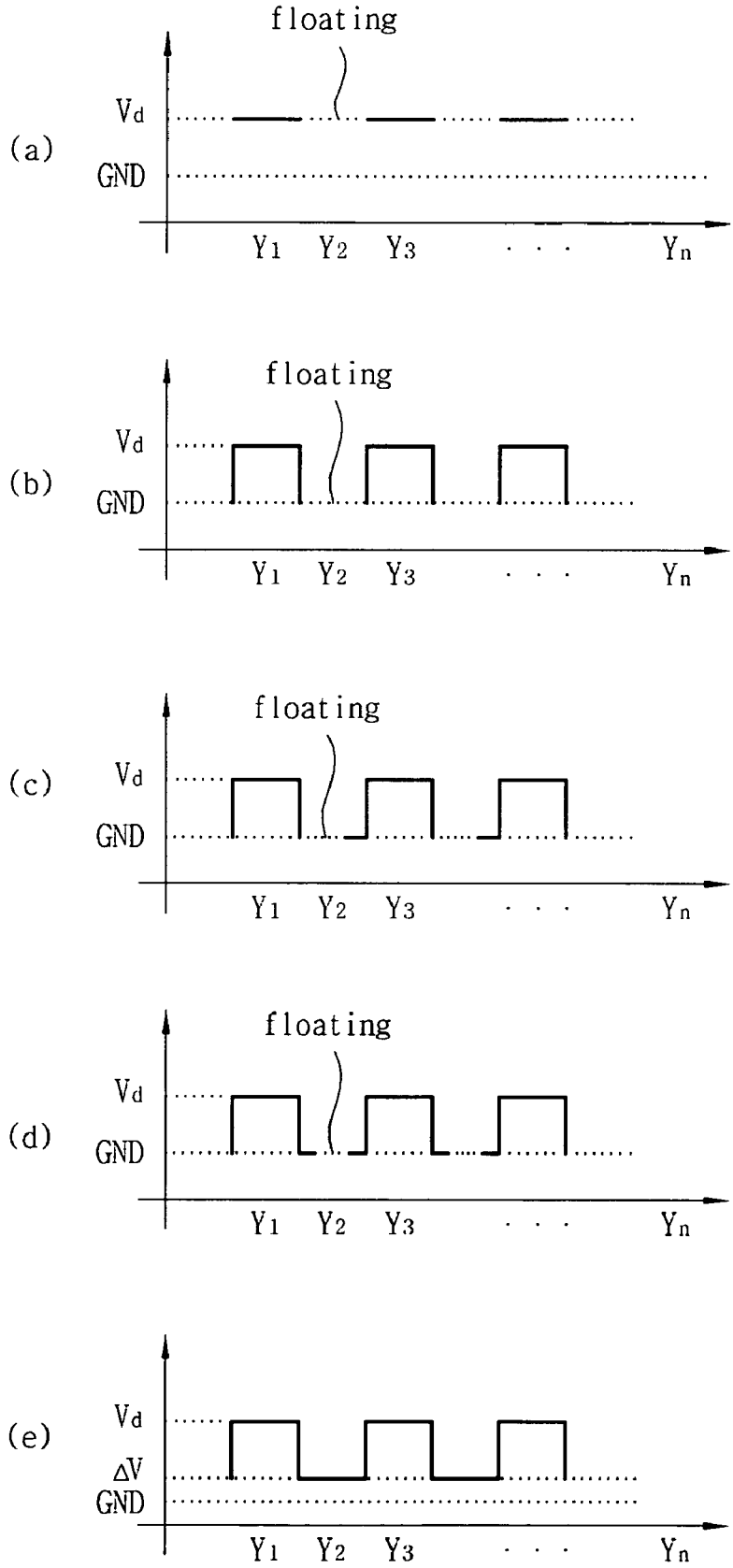
FIGS. 10*a* to 10*e* are graphs illustrating various kinds of variance in a data electrode depending on an operation mode of a data driver IC included in a plasma display apparatus according to the present invention.

Referring to FIG. 10*b*, when data are supplied to data electrodes as a lattice pattern, electric potential of a data electrode varies from a data reference voltage (Vd) to a ground (GND) level and then are maintained as a floating state before the next data reference voltage is applied. The electric potential applied to a data electrode in such a manner varies depending on operations of switching elements included in the present invention. First, the first data switching elements 300-1 to 300-*m* within the data driver IC perform switching operations to apply the data reference voltage (Vd) to a data electrode as shown in FIG. 9*a* and then the second data switching elements 330-1 to 330-*m* perform switching operations as shown in FIG. 9*b* so that a data electrode falls to a ground level. Thereafter, the first data switching elements and the second data switching elements are turned off and maintained as a floating state as shown in FIG. 9*c* so that the displacement current of the data in accordance with the lattice pattern can be reduced.

Referring to FIGS. 10*c* and 10*d*, when data are supplied to data electrodes as a lattice pattern, electric potential of a data electrode varies from a data reference voltage (Vd) to a ground (GND) and then are maintained as respective ground level and floating states during a predetermined period within a period before the next data reference voltage (Vd) is applied. In other words, seeing how electric potention of a data varies with reference to only FIG. 10*c*, first, the first data switching elements 300-1 to 300-*m* within the data driver IC perform switching operations to apply the data reference voltage (Vd) to a data electrode as shown in FIG. 9*a* and then the second data switching elements 330-1 to 330-*m* perform switching operations so that a data electrode falls to a ground level and a ground level is maintained during a predetermined period as shown in FIG. 9*b*. Thereafter, the first data switching elements and the second switching elements are turned off and maintained as a floating state as shown in FIG. 9*c*, or thereafter, the second data switching elements perform switching operations again so that a data electrode maintains a ground level as shown in FIG. 9*b*, whereby the electric potential of a data electrode varies as shown in FIG. 10*d*. Accordingly, the displacement current in accordance with a lattice pattern can be reduced.

Referring to FIG. 10*e*, when data are supplied to data electrodes as a lattice pattern, electric potential of a data electrode varies to a voltage (Vd-.DELTA.V) which is higher than a ground (GND) level and lower than a data reference voltage (Vd), and is maintained as a state before the next reference voltage (Vd) is applied. The electric potential applied to a data electrode in such a manner varies depending on operations of switching elements included in the present invention. First, the first data switching elements 300-1 to 300-*m* within the data driver IC are turned on to a data reference voltage (Vd) source to apply the data reference voltage (Vd) to a data electrode as shown in FIG. 9*a*, and then the first data switching elements 300-1 to 300-*m* are turned on to a source of a voltage (Vd-.DELTA.V) which is higher than a ground (GND) level and lower than a data reference voltage (Vd).

Accordingly, contrary to electric potential varying from a conventional data reference voltage (Vd) to a ground (GND) level, electric potential generated due to variance from a data reference voltage (Vd) to a voltage (Vd-ΔV) higher than a ground (GND) level is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel in which data electrodes are formed; and a data voltage controller comprising a first data switching element for controlling application of a data reference voltage and a second data switching element for controlling application of a ground level, wherein the data voltage controller is configured to apply a data voltage as a ground level and a floating state between the application of the data reference voltage to the data electrodes throughout an address period, wherein the first and second data switching elements are turned off to form the floating state, and wherein the application of the floating state of the data voltage or the application of the ground level of the data voltage is adjusted depending on the magnitude of a displacement current by the data voltage.

2. The apparatus of claim 1, wherein an interval in which a ground level is applied to data electrodes includes the floating state when an electric potential applied to the data electrodes varies from a data reference voltage to a ground level.

3. The apparatus of claim 2, wherein the floating state is generated at a portion of the interval in which the ground level is applied to data electrodes when an electric potential applied to the data electrodes varies from a data reference voltage to a ground level.

4. The apparatus of claim 1, wherein the floating state is generated at an interval in which a ground level is applied to data electrodes when an electric potential applied to the data electrodes varies from a data reference voltage to a ground level.

5. The apparatus of claim 1, wherein the floating state is generated from the data reference voltage electrodes when an electric potential applied to the data electrodes varies from a data reference voltage to a ground level.

6. A method of driving a plasma display apparatus which is driven by applying a data voltage to data electrodes, the method comprising the steps of:

applying a data reference voltage to the data electrode; and controlling a first data switching element for application of the data reference voltage and a second data switching element for application of a ground level;

applying a voltage as a ground level and a floating state wherein the floating state is applied between applications of the data reference voltage throughout an address period, wherein the first and second data switching elements are turned off to form the floating state wherein the application of the ground level or the application of the floating state is adjusted depending on the magnitude of a displacement current by a data voltage.

7. The method of claim 6, wherein the floating state is generated at an interval in which a ground level is applied to data electrodes when an electric potential applied to the data electrodes varies from the data reference voltage to a ground level.

8. The method of claim 6, wherein the floating state is generated from the data reference voltage when an electric potential applied to the data electrodes varies from the data reference voltage to a ground level.

* * * * *